US005167749A

United States Patent [19]

Kasak

[11] Patent Number: 5,167,749

[45] Date of Patent: Dec. 1, 1992

[54] LABELLING MACHINE AND METHOD

[76] Inventor: Carl A. Kasak, 1655 Densmore St., Pomona, Calif. 91767

[21] Appl. No.: 523,370

[22] Filed: May 15, 1990

[51] Int. Cl.[5] ..... B65C 3/00

[52] U.S. Cl. ..... 156/446; 156/447; 156/457; 156/578

[58] Field of Search ..... 156/446, 447, 457, 570, 156/578

[56] References Cited

U.S. PATENT DOCUMENTS 701,229 5/1902 Strasburger ..... 156/446

3,278,359 10/1966 Wesley ..... 156/351

*Primary Examiner*—David A. Simmons

*Assistant Examiner*—James J. Engel, Jr.

*Attorney, Agent, or Firm*—Denton L. Anderson

[57] ABSTRACT

A method and apparatus is provided for semi-automatically applying a label to a cylindrical container. The method comprises the steps of removing a label from a label repository and transporting it into contact with a glue-retaining surface and then into contact with a rotating cylindrical container. The cylindrical container is rotated at a surface speed which is slightly faster than the speed at which the label is moved past the glue-retaining surface. Therefore, when the leading edge of the label comes into contact with the rotating cylindrical container, the central portion of the label is pulled away from the glue-retaining surface. As the label is drawn by the rotating cylindrical container, the trailing edge of the label is caused to contact the glue-retaining surface. By this method, glue is automatically applied to the leading edge and to the trailing edge of a label but not applied to the central portion of the label, and the label is automatically applied to a cylindrical container.

16 Claims, 5 Drawing Sheets

10
86
90
84
82
92
70
96
26
24
22
36
28
34
94
102
100
132
60
26
96
72
56
74
48
54
58

20
14

LABELLING MACHINE AND METHOD

FIELD OF THE INVENTION

This invention relates generally to the field of methods and machines for applying labels to cylindrical containers, and specifically to the field of semi-automatic labelling machines.

BACKGROUND OF THE INVENTION

In the application of labels to cylindrical containers, it is generally desirable to avoid the application of glue to the entire backside of the label. Applying glue to the entire backside of the label uses excessive quantities of glue and frequently causes blistering and/or wrinkling of the label. It is therefore generally desirable to apply glue to the label only along two opposing edges.

A method and apparatus for semi-automatically applying labels to cylindrical containers in such a way that only two opposing edges are contacted with glue is described in U.S. Pat. No. 3,278,359 issued to John G. Wesley in 1966. The Wesley patent provides an apparatus which takes a label from a label repository and brings that label into contact with a glue-retaining surface and then applies the label to a cylindrical container. After the label comes into initial contact with the glue-retaining surface, the label is separated from the glue-retaining surface by reciprocating lifting fingers so that glue is not applied to the central portion of the label. The fingers then retract so that glue is applied to the trailing edge of the label.

The Wesley patent method and device is not entirely satisfactory, however. The reciprocating lifting fingers and the associated timing mechanism and solenoid switches must be maintained in precise adjustment or the glue will be mis-applied to the label. Such precision is difficult to maintain in reciprocating machinery being operated day in and day out. Furthermore, in the Wesley apparatus, the timing of the lifting fingers must be accurately reset every time labels of different lengths are used in the machine. In short, the Wesley patent apparatus is expensive to manufacture, difficult and expensive to maintain and awkward and inefficient to operate.

Therefore, there is a need for a semi-automatic labelling method and machine capable of consistently metering glue to opposing edges of a label without the necessity of precisely timed reciprocating lifting fingers.

Also, there is a need for such a method and machine which is less expensive to manufacture, maintain and operate than the method and machine described in the Wesley patent.

SUMMARY OF THE INVENTION

The labelling machine of the invention solves these needs.

The invention is a device useful for semi-automatically applying a label to a cylindrical container such as a can, bottle, fibrous container, etc. The device comprises a label repository, a glue-retaining surface and means for retaining and rotating a cylindrical container. The invention further comprises transport means for removing a label from the label repository and transporting the label into contact with the glue-retaining surface, removing the label from the glue-retaining surface and applying the label to the container. First deflection means are provided for deflecting the leading edge of the traveling label into initial contact with the glue-retaining surface in such a way that the label contacts the glue-retaining surface at an acute angle. Second deflection means are provided for lifting the leading edge of the label off of the glue-retaining surface and directing the leading edge to a rotating container in such a way that the leading edge contacts the container at an acute angle. Between the point where the leading edge first contacts the glue-retaining surface and the point at which the second deflection means lifts the leading edge from the glue-retaining surface, a second surface is disposed proximate to the glue-retaining surface to define a narrow slit through which the travelling label passes. The label is transported to the glue-retaining surface at a first velocity and the container is rotated at a surface velocity which is greater than the first velocity.

The invention provides a means by which a label is removed from the label repository and transported to the first deflection means where the leading edge is deflected to the glue-retaining surface at an acute angle. When the leading edge contacts the glue-retaining surface, the leading edge picks up glue from the glue-retaining surface. The label passes through the narrow slit and is thereafter lifted off of the glue-retaining surface by the second deflection means. The second deflection means further directs the leading edge of the travelling label to the rotating container where the leading edge is caused to adhere to the rotating container by the glue which was picked up by the leading edge from the glue-retaining surface. When the leading edge adheres to the rotating container, the rotating container pulls on the label at a speed greater than the speed at which it was transported to the glue-retaining surface. The sudden increase in the speed of the travelling label causes the label to be pulled away from the glue-retaining surface and into contact with the second surface. By this action, the central portion of the label is taken out of contact with the glue-retaining surface so that no glue is supplied to this area of the label.

In preferred embodiments, the apparatus is constructed so that as the trailing edge of the label approaches the glue-retaining surface, the trailing edge is caused to come into contact with the glue-retaining surface so as to pick up glue on the trailing edge.

As can be seen, the invention provides a method and an apparatus whereby labels can be semi-automatically applied to cylindrical containers such that glue is applied only to the leading edge and trailing edge of the label without the necessity of precisely timed reciprocating lifting fingers.

The glue-retaining surface preferably has one or more radial grooves within each of which is disposed a single stationery lifting finger which acts as the second deflecting surface.

In one embodiment of the invention, the second surface is cylindrical or has a cross-section which at least defines a portion of a circle. Likewise, the first deflection means can be cylindrical or have a cross-section which defines a portion of a circle. In preferred embodiments, the second surface provides the first deflection means. In such embodiments, the first deflection surface can be cylindrical and can be rotated in the direction of the travelling label at a surface velocity approximately equal to the second velocity.

The second deflection means can comprise a finger member having an arcuate edge for lifting the leading edge of the travelling label off of the glue-retaining surface and deflecting that leading edge toward the container.

The difference between the first velocity and the second velocity is not critical so long as the second velocity is slightly greater than the first velocity. In preferred embodiments the first velocity is less than about 99.9% of the second velocity and is generally between about 98% and about 99.5% of the second velocity.

The invention is also a method for applying a label to a cylindrical container comprised of the steps of (i) removing a label from the label repository and serially causing the label to travel at a first velocity into contact with a first deflection means which deflects the leading edge of the travelling label to a glue-retaining surface, whereupon the leading edge is caused to retain a layer of glue, the deflection being made in such a way that the leading edge of the label contacts the glue-retaining surface at an acute angle; (ii) lifting the leading edge of the travelling label off of the glue-retaining surface and deflecting the leading edge to a cylindrical container which is being rotated at a surface velocity which is greater than the velocity at which the label is travelling; and (iii) contacting the rotating cylindrical container with the leading edge of the travelling label at an acute angle so that the travelling label is retained on the container and is pulled by the container, whereby the sudden increase in the label speed pulls the label out of contact with the glue-retaining surface so that no glue is applied to the central portion of the label. In a preferred embodiment, the trailing edge of the travelling label is thereafter caused to come into contact with the glue-retaining surface so that glue is applied to the trailing edge as well as to the leading edge.

SUMMARY OF THE DRAWINGS

These and other features, aspects and advantage of the present invention will become understood with reference to the following description, appended claims and accompanying drawings where:

DETAILED DESCRIPTION

Figures 1, 2:
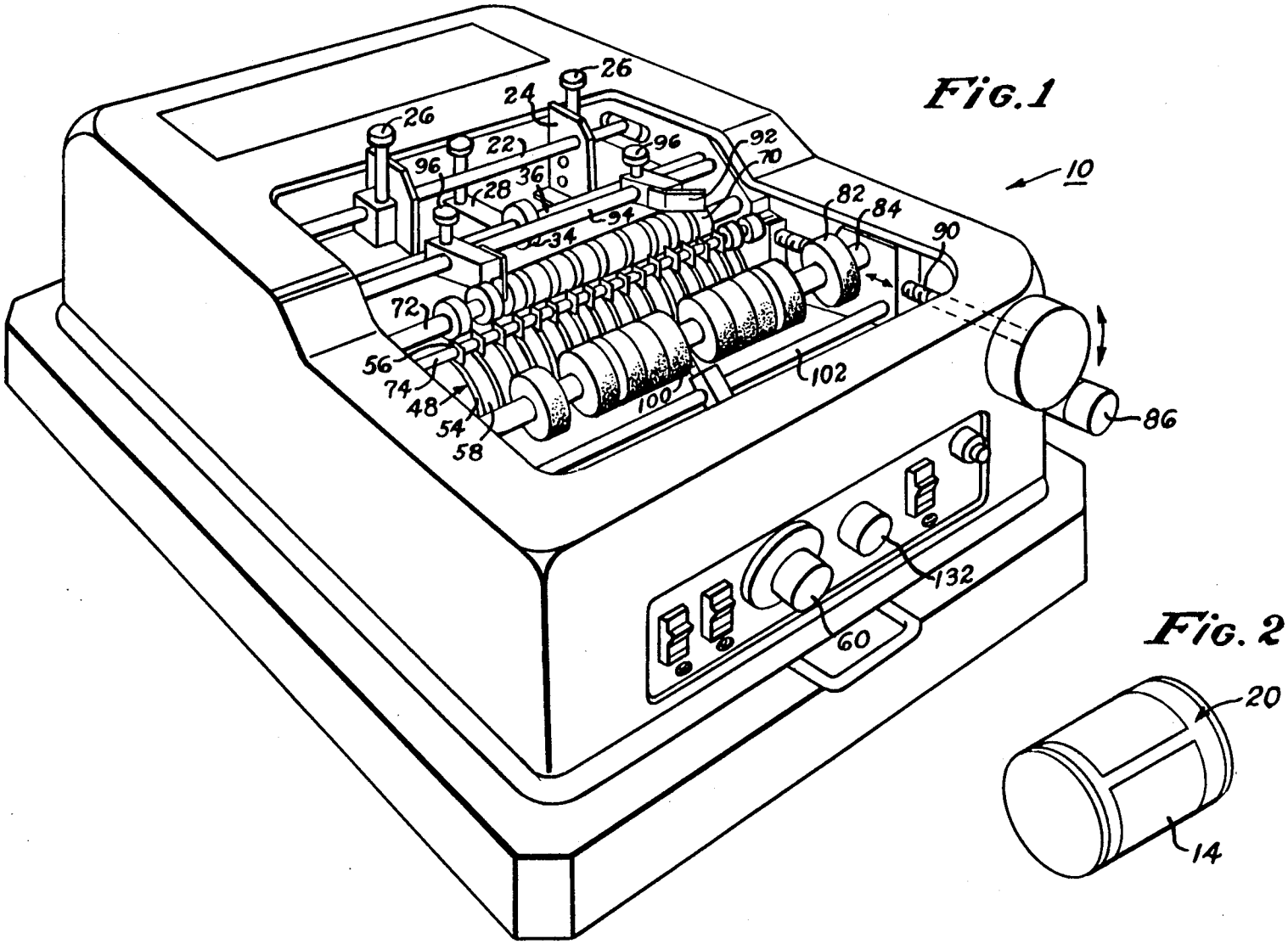
FIG. 1 is a perspective view of a labelling machine having features of the invention.
FIG. 2 is a perspective view of a cylindrical container for which the invention has been used to apply a container label.

The labelling machine 10 of the invention comprises (i) a label repository and removal system, (ii) a glue application system, (iii) a container retention and rotating system, and (iv) a drive system.

The label repository and removal system comprises a label repository 12 for storing a plurality of labels 14 and transport means for removing a label 14 from the label repository 12 and serially transporting the label 14 into contact with (i) a first surface 16 to which is retained a layer of glue 18 and (ii) a cylindrical container 20 retained within the container retention and rotating system.

The label repository 12 comprises a label support bar 22 and a pair of label guides 24. The distance between the pair of label guides 24 can be increased or decreased by sliding the label guides 24 along the label support bar 22. Each label guide 24 can be clamped securely to the label support bar 22 by tightening down on a label guide adjustment pin 26.

A label feed table 28 is disposed at the base of the label repository 12. The label feed table 28 terminates at a rearward-most edge 30 proximate to the first deflection surface 32 (described below). A label feed roller 34 is disposed immediately above the label feed table 28. The label feed roller 34 is rotatable and is disposed so that a label 14 which gravitates to between the label feed roller 34 and the label feed table 28 is drawn by the rotating label feed roller 34 away from the label support bar 22 and to the glue application system at a first velocity. The label feed table 28 can be any relatively smooth surface which imposes little frictional resistance to a label 14 in contact with the upper side of the label feed table 28. The inventor has found, however, that an excessively smooth surface may allow more than one label 14 to be transported simultaneously by the feed roller 34. A slight roughening of such surface may be required to assure that only one label 14 is processed at a time. Conversely, the label feed roller 34 is preferably composed of a rubber, resilient plastic or other material having a relatively high coefficient of friction so as to be able to move a label 14 along the label feed table 28 without slippage.

Figure 4:
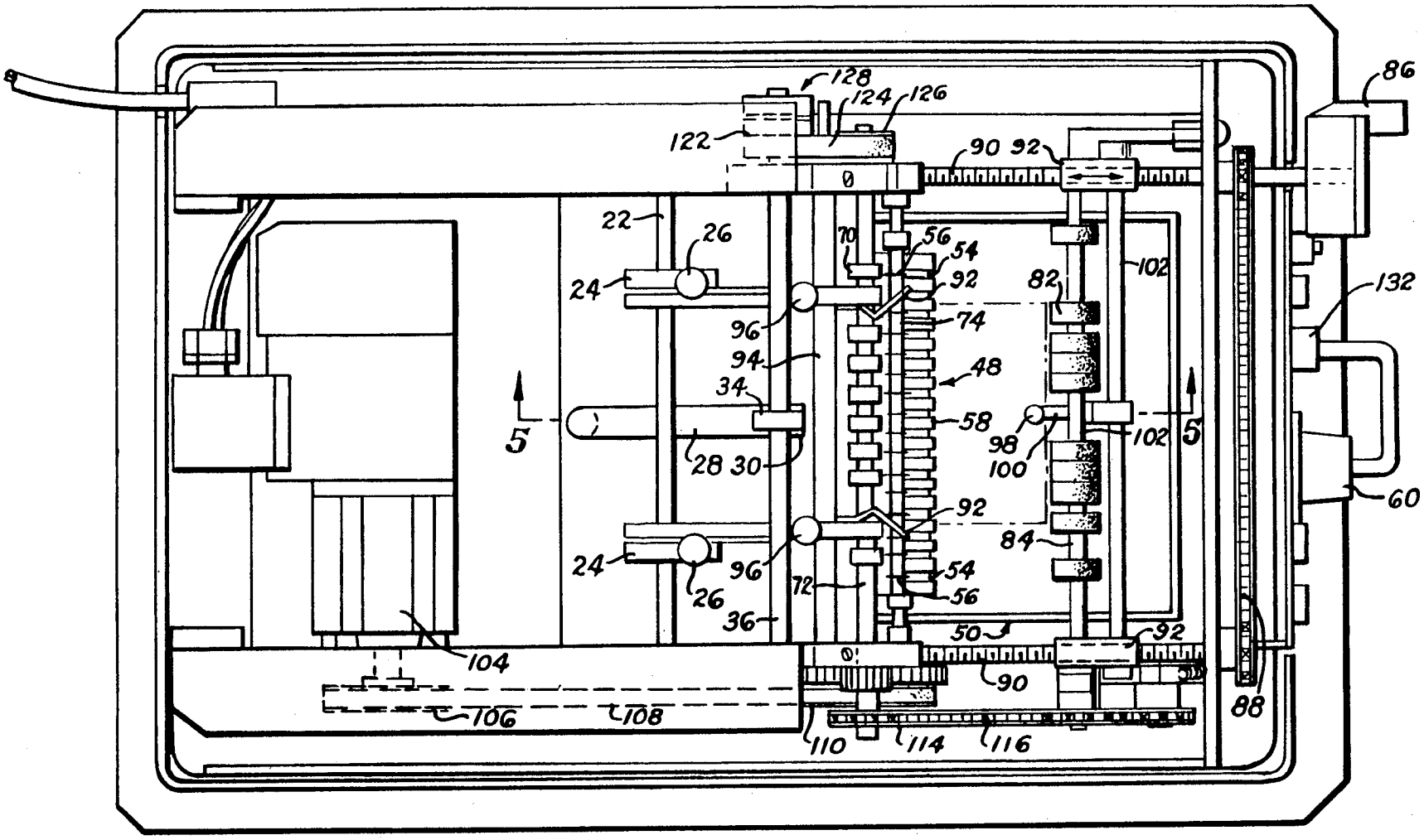
FIG. 4 is a top view in partial cross-section of the labelling machine of FIG. 1.

As shown in FIG. 4, the label feed roller 34 is rotatably disposed upon and is rotated by a label feed roller shaft 36 which is connected to the drive system.

The glue application system comprises the first surface 16 capable of retaining the layer of glue 18, a second surface 40 disposed spaced-apart from, but proximate to, the first surface 16 (so as to define a narrow slit 42 between the first surface 16 and the second surface 40), a first deflection means comprised of the first deflection surface 32 for deflecting the leading edge 44 of a travelling label 14 in such a way that the bottom side 46 of the leading edge 44 of the label 14 contacts the first surface 16 at an acute angle (such contact between the leading edge 44 and the first surface 16 occurring proximate to, and on the upstream side of, the narrow slit 42 between the first surface 16 and second surface 40), and second deflection means for lifting the leading edge 44 of the travelling label 14 off of the first surface 16 at a location downstream of the narrow slit 42 and deflecting the leading edge 44 away from the first surface 16 to a container 20 which may be retained within and rotated by the container retention and rotating system in such a way that the leading edge 44 of the travelling label 14 contacts such container 20 at an acute angle.

As shown in FIGS. 5–8, the first surface 16 can be a glue application roller 48 partially immersed in glue 38 within a glue pan 50. In the embodiment illustrated in the drawings, the glue application roller 48 is rotatably affixed on a glue application roller shaft 52 which is rotatable by the drive system.

Preferably, the glue application roller 48 defines one or more radial grooves 54. Such grooves 54 serve two functions. Firstly, the grooves 54 allow finger members 56 (described below) to be disposed below the outermost surface 58 of the glue application roller 48 so that the finger members 56 are disposed below a label 14 in contact with the outermost surface 58 of the glue application roller 48 and can easily lift the label 14 off of the outermost surface 58. Secondly, the grooves 54 limit the glue-retaining surface of the glue application roller 48 so that glue is applied to a label 14, not continuously across the back of the label 14, but in bands whose width is defined by the width and number of grooves 54. By applying glue in bands instead of continuously, excessive glue is not applied which might cause the label 14 to wrinkle or pucker. Also, applying glue in bands minimizes the amount of glue used.

The glue application roller 48 can be any appropriate size. The glue application roller 48 can be rotated at any speed which adequately coats the glue application roller outermost surface 58. Glue application roller rotations of approximately 100 rpm can be used in the invention.

The glue application roller 48 can be made of any suitable surface capable of picking up and retaining a thin layer of hot or cold glue, retaining the glue on its surface and imparting the glue to a label 14 in contact with its surface 58. The glue application roller 48 can be constructed of aluminum. Where water soluble glues are used, however, the glue and application roller 48 may be constructed of brass to minimize pitting.

The glue pan 50 can be any suitable shallow container capable of retaining an inventory of glue. Preferably, the glue pan 50 is capable of heating and maintaining a glue to temperatures of approximately 300° F. This capability will allow the apparatus 10 to use most commercially available hot melt glues. A thermostat (not shown), operated by a thermostat adjustment dial 60, can be used for controlling the temperature of glue within the glue pan 50.

It is also preferable that the glue pan 50 comprise a baffle 62 such as illustrated in FIGS. 5–8, to prevent glue within the glue pan 50 from overflowing the back of the pan 50 when the lower portion of the glue application roller 48 rotates in that direction. Without such a baffle 62, highly viscous glues may tend to build up in the back of the pan 50 and/or overflow out of the pan 50.

In the embodiment illustrated in the drawings, a glue adjustment roller 64 is disposed in close proximity to the glue application roller 48 at a point slightly above where the surface of the glue application roller 48 first emerges from the volume of glue 38 within the glue pan 50. By adjusting the proximity of the glue adjustment roller 64 to the glue application roller 48, the thickness of glue 18 retained upon the surface 58 of the glue application roller 48 can be controlled. In the embodiment illustrated in the drawings, the glue adjustment roller 64 is adjusted by tightening down or loosening up glue adjustment roller adjustment bolts 66 disposed within a bearing block 68.

Also in the embodiment illustrated in the drawings, the first deflection means for deflecting the leading edge 44 of the travelling label 14 is provided by a plurality of forward container support collars 70 each of which serves as (i) the second surface 40 and (ii) a portion of the container retention and rotating system described below. The forward container support collars 70 are rotatably attached upon a forward container support shaft 72.

The forward container support collars 70 are disposed spaced apart from but proximate to the glue application roller 48 so as to define the narrow slit 42 between the glue application roller 48 and the forward container support collars 70. The width of the narrow slit 42 is not critical. Widths of between 0.2 cm. and 1.2 cm. can be used. Other widths maybe used as well.

The second deflection means for lifting the leading edge 44 of the travelling label 14 off of the glue application roller 64 at a location downstream of the narrow slit 42 and deflecting the leading edge 44 away from the glue application roller 48 is provided in the embodiment illustrated in the drawings by a plurality of thin fingers 56 disposed in fixed spacial relationship with one another along a finger bar 74. Each of the fingers 56 has an arcuate edge 76, a lowermost portion 78 and an uppermost portion 80. In the embodiment illustrated in the drawings, each of the fingers 56 is disposed within a groove 54 in the glue application roller 48 so that the lowermost portion 78 of the arcuate edge 76 is disposed below the outermost surface 58 of the glue application roller 48. The fingers 56 are disposed immediately downstream of the narrow slit 42 between the glue application roller 48 and the forward container support collars 70. The uppermost portion of the arcuate edge 80 of each of the fingers is disposed proximate to the location where a container 20 is retained by the container retention and rotating system. The fingers 50 can be constructed of any suitable, rigid material. Metal materials can be used. Brass is preferred where the glue used is water-based because of brass' resistance to pitting and the ease with which brass can be stamped out.

The container retention and rotating system comprises the forward container support collars 70 and a plurality of rearward container support rollers 82. The rearward container support rollers 82 are rotatably disposed on a rearward container support shaft 84 as shown in FIG. 4. The rearward container support shaft 84 is rotated by the drive system. The rearward container support rollers 82 are preferably made of rubber or some other material having a high coefficient of friction so that, when the rearward container support rollers 82 are rotated along the rearward container support shaft 84 by the drive system, a cylindrical container 20 in contact with the rearward container support rollers 82 will be rotated without significant slippage.

The rearward container support shaft 84 is adjusted relative to the forward container support shaft 72 by turning a container support assembly adjustment crank 86 which turns, via a container support assembly adjustment chain 88, a container support assembly adjustment screw 90 located on both sides of the device 10. As can be seen in FIG. 4, the rotation of the container support assembly adjustment screw 90 moves the rearward container support shaft block 92 in either a forward or rearward direction relative to the forward container support shaft 72.

The forward container support collars 70 can be made from any suitable material which has a relatively low coefficient of friction to minimize drag on labels 14 travelling past the collars 70. Stainless steel is such a suitable material.

The forward container support shaft 72 and the rearward container support shaft 84 are disposed spaced apart parallel to one another in such a way that a typical cylindrical container 20 can be supported from underneath by the forward container support collars 70 and by the rearward container support rollers 82.

The forward container support collars 72 and the rearward container support rollers 82 are disposed in approximately the same horizontal plane. As shown in FIGS. 5–8, such plane is disposed so that a container retained upon the forward container support collars 70 and the rearward container support rollers 82 is above the glue application roller 48. Furthermore, the rearward-most edge 30 of the label support table 28 is also disposed at an elevation above the glue application roller 48. The first deflection surface 32 is disposed at an elevation intermediate between the glue application roller 48 and both the label feed table 28 and a container 20 retained upon the forward container support collars 70 and the rearward container support rollers 82.

As shown in FIG. 4, a pair of container guide members 92 are slidably attached along a container guide bar 94 to retain a container 20 supported by the forward container support collars 70 and the rearward container support rollers 82 at a predetermined position so that a label 14 is applied to the container 20 at an appropriate location on the container 20. The container guide members 92 can be firmly clamped to the container guide bar 94 by tightening down on a container guide adjustment pin 96.

Preferably, an automatic system engaging device is provided to automatically actuate the apparatus 10 of the invention when a cylindrical container 20 is placed in the apparatus 10. Such an automatic system engaging device is provided in the embodiment illustrated in the drawings by a contact trigger 98 which is disposed at the end of a trigger arm 100. The opposite end of the trigger arm 100 engages a trigger arm shaft 102 which, when partially rotated, engages an electrical switch (not shown) which engages the drive system. The contact trigger 98 is disposed at the end of the trigger arm 100 so that placing a cylindrical container 20 on the forward container support collars 70 and the rearward container support rollers 82 contacts depresses the contact trigger 98. This action deflects the trigger arm 100 downwardly, causing the trigger arm shaft 102 to rotate thereby engaging the electrical switch.

Figure 3:
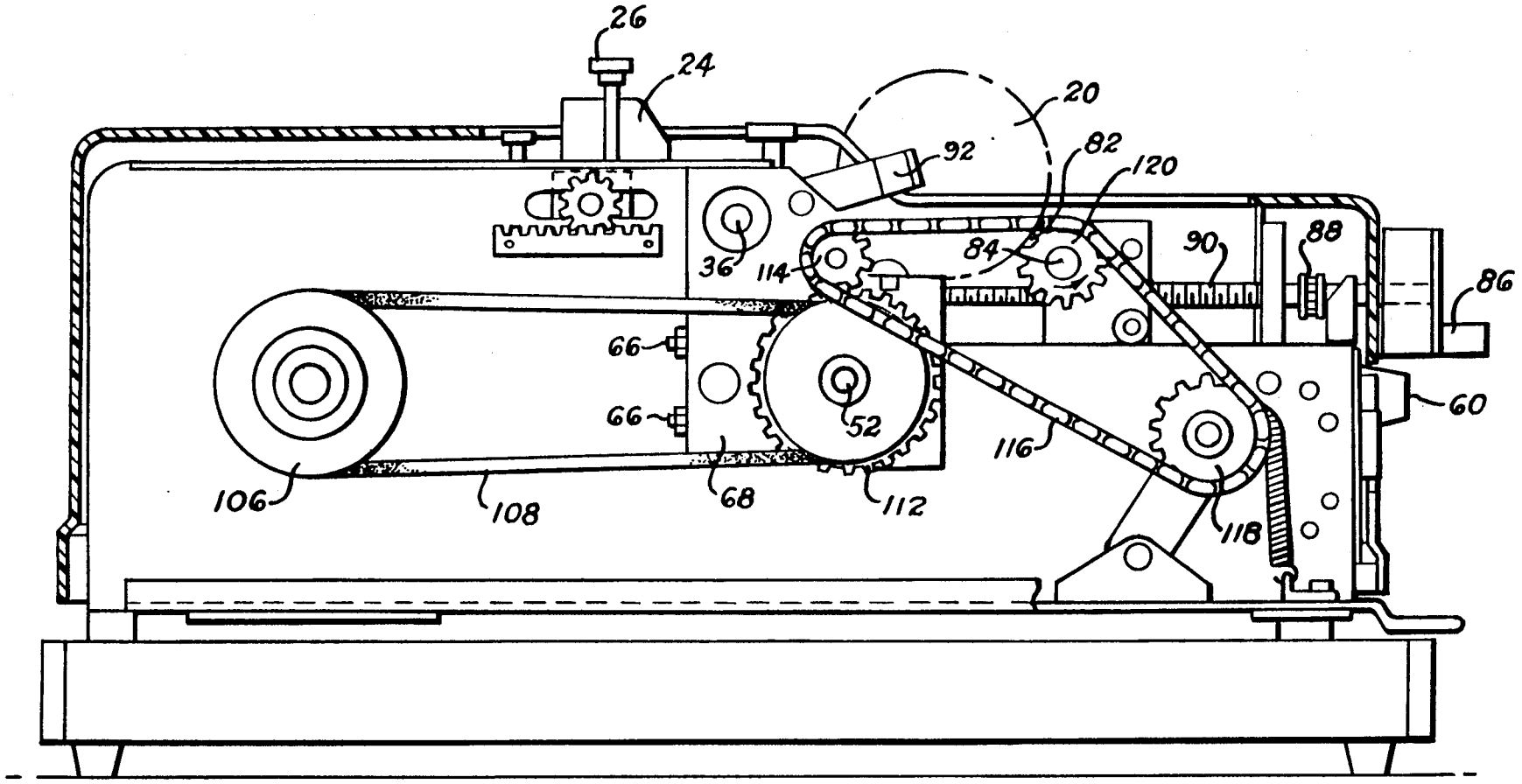
FIG. 3 is a cross-sectional view of the labelling machine of FIG. 1.

The drive system is illustrated in FIGS. 3 and 4. An electrical motor 104 turns a motor sheave 106 which, in turn, turns a drive belt 108. The drive belt turns a glue application roller sheave 110 which is rotatably attached at one end of the glue application roller shaft 52. A glue application roller gear 112 is also disposed on the glue application roller shaft 52 outboard of the glue application roller sheave 110. The glue application roller gear 112 engages a forward container support assembly sprocket 114 which is attached at one end of the forward container support shaft 52. A drive chain 116 is disposed around the forward container support assembly sprocket 114, an idler sprocket 118 and a rearward container support assembly sprocket 120 which is attached at one end of the rearward container support shaft 84. Thus, when the motor 104 is actuated, the motor sheave 106 turns the drive belt 108, which in turn turns the glue application roller sheave 110. The rotation of the glue application roller sheave 110 rotates the glue application roller shaft 52. The rotation of the glue application roller shaft rotates the glue application roller gear 112 which, in turn, rotates the forward container support support sprocket 114. The rotation of the forward container support support sprocket 114 turns the drive chain 116 which, in turn, turns the rearward container support support sprocket 120.

The label feed roller shaft 36 is rotated by a forward cog pulley 122 which, in turn, is rotated by a cog belt 124 disposed around a rearward cog pulley 126. The rearward cog pulley 126 is rotatably disposed on the end of the forward container support shaft 72 opposite the forward container support sprocket. In the embodiment illustrated in the drawings, an electrically actuated clutch assembly 128 is used to engage the label feed roller shaft 36 upon actuation by the switch (described above). The clutch 128 can be adjusted to remain engaged for different time periods by a potentiometer (not shown). Such adjustment may be necessary for excessively long or excessively short labels 14. A clutch time adjustment dial 132 disposed on the front of the device 10 is used by the operator to manipulate the potentiometer.

Figure 5:
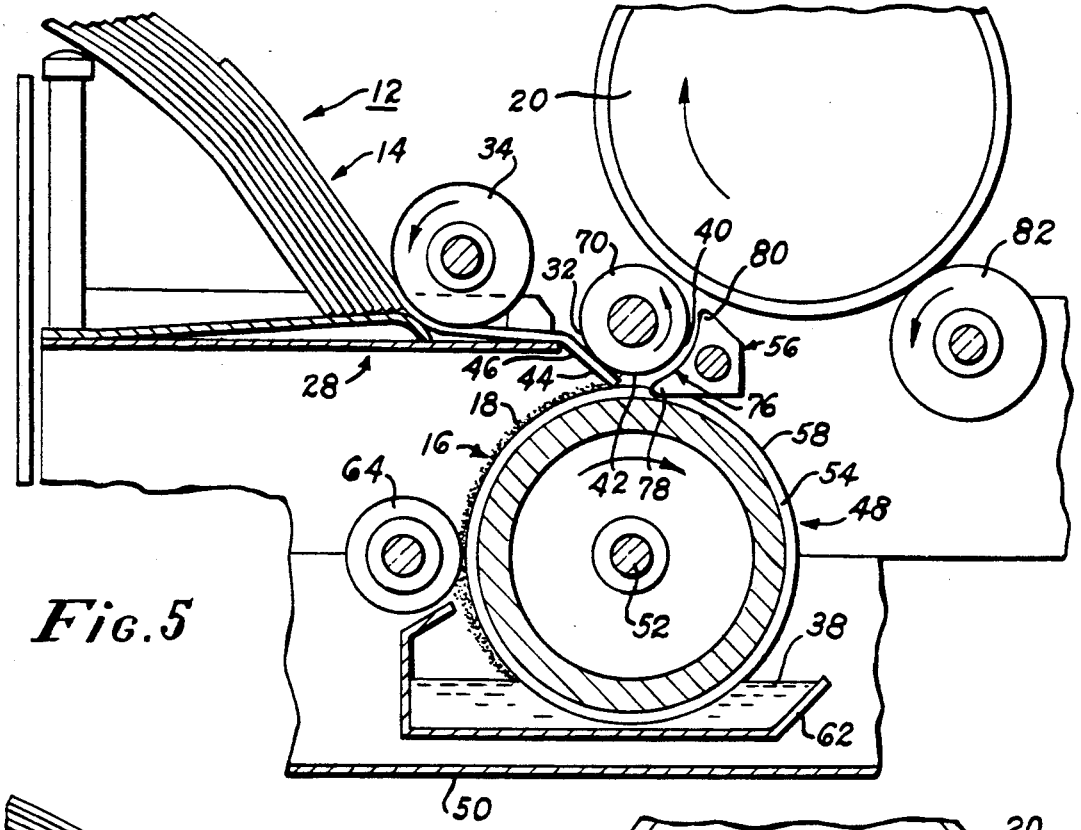
FIG. 5 is a cross-sectional view in diagrammatic form of the labelling machine of FIG. 1 showing a label being transported from a label repository and into initial contact with a glue-retaining surface.

In operation, an operator turns on the motor 104 and places a stack of labels 14 in the label repository 12. As shown in FIG. 5, the labels 14 are disposed so that they lean up against the label support bar 22 and their leading edges 44 are disposed proximate to the label feed roller 34. The operator then places an unlabelled cylindrical container 20 in the container retention and rotating system by supporting the container 20 between the forward container support collars 70 and the rearward container support rollers 82. The weight of the container 20 presses down against the contact trigger 98 which, in turn, depresses the trigger arm 100, which rotates the trigger arm shaft 102 and engages the electrical switch to the clutch assembly 128. The clutch assembly 128 is engaged for a pre-set time period as controlled by clutch time adjustment dial 132. The motor 104 causes the rotation of the glue application roller 48, the forward container support collars 70 and the rearward container support rollers 82. When the clutch assembly 128 is engaged, the label feed roller 34 begins to turn.

By gravity, a label 14 is caused to move into the slight gap 134 between the label feed roller 34 and the label feed table 28. The frictional action of the label feed roller 34 causes the label 14 to slide along the label feed table 28 towards the forward container support collars 70 when the leading edge 44 of the label 14 contacts the outermost surface 58 of the glue application roller 48 at an acute angle.

The glue application roller 48 is rotated through glue 38 within the glue pan 50. By this action, the glue application roller 48 picks up and retains glue 18 on its outermost surface 58. As the glue application roller 48 rotates out of the glue 38, the thickness of the glue 18 retained on the glue application roller surface 58 is metered by the glue adjustment roller 64.

Figure 6:
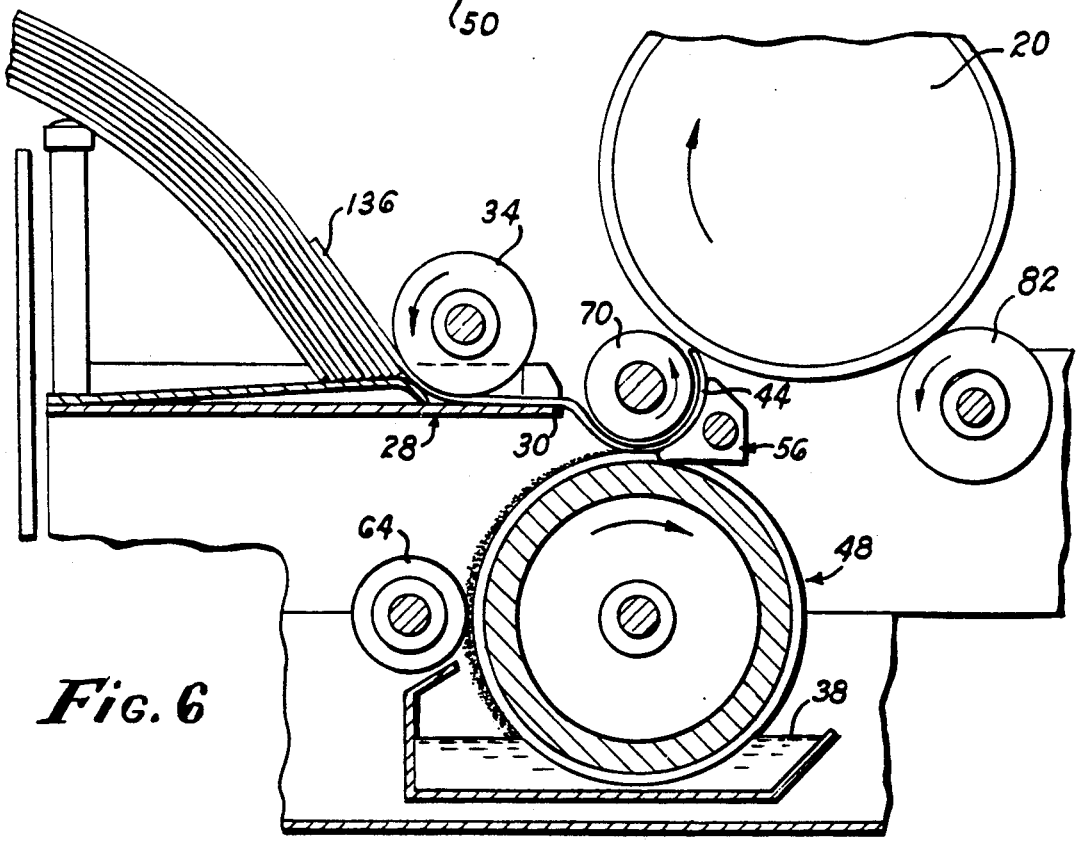
FIG. 6 is a cross-sectional view in diagrammatic form of the labelling machine of FIG. 1 showing a travelling label as the label comes into initial contact with a rotating cylindrical container.

When the leading edge 44 of the travelling label 14 contacts the glue application roller 48 at an acute angle, the leading edge 44 is caused to adhere to the surface 58 of the glue application roller 48, whereupon the leading edge 44 of the label 14 contacts the glue 18 retained on the glue application roller surface 58. The leading edge 44 of the label 14 is moved through the narrow slit 42 and is then lifted off the surface 58 of the glue application roller 48 by the fingers 56. As illustrated in FIG. 6, the leading edge 44 of the label 14 is thereafter directed away from the surface 58 of the glue application roller 48 by the arcuate edge 76 of each finger 56 and is further directed to a container 20 which is retained within the container retention and rotating system.

The container 20 is rotated by the rotation of the rearward container support rollers 82 at a surface speed on the container 20 which is slightly faster than the speed at which the label 14 is transported past the glue application roller 48 by the label feed roller 34.

Figure 7:
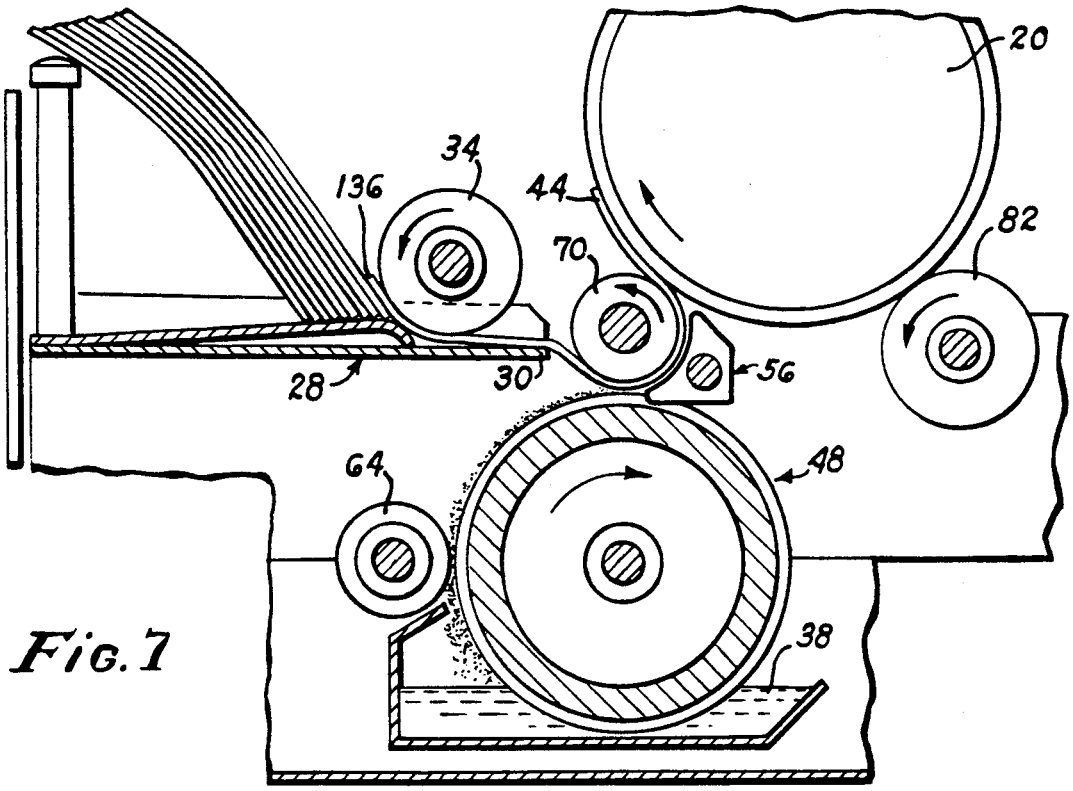
FIG. 7 is a cross-sectional view in diagrammatic form of the labelling machine of FIG. 1 showing a travelling label after it has been retained by the rotating cylindrical container.

As illustrated in FIG. 7, the leading edge 44 of the label 14 is directed by the arcuate edge 76 of the fingers 56 to contact the rotating container 20 at an acute angle. Because of the glue on the underside 46 of the leading edge 44 (caused by the contact of the leading edge 44 with the glue application roller 48), the leading edge 44 adheres to the rotating container 20 and is pulled thereby.

The sudden increase in speed (because the container 20 is rotating at a surface speed which is faster than the speed of the label 14 as it passes the glue application roller 48), the label 14 is pulled away from the surface 58 of the glue application roller 48 and snugly up against the surface of the forward container support collars 70. By this action, the central portion of the label 14 is allowed to travel past the glue application roller 48 without taking on any glue.

Figure 8:
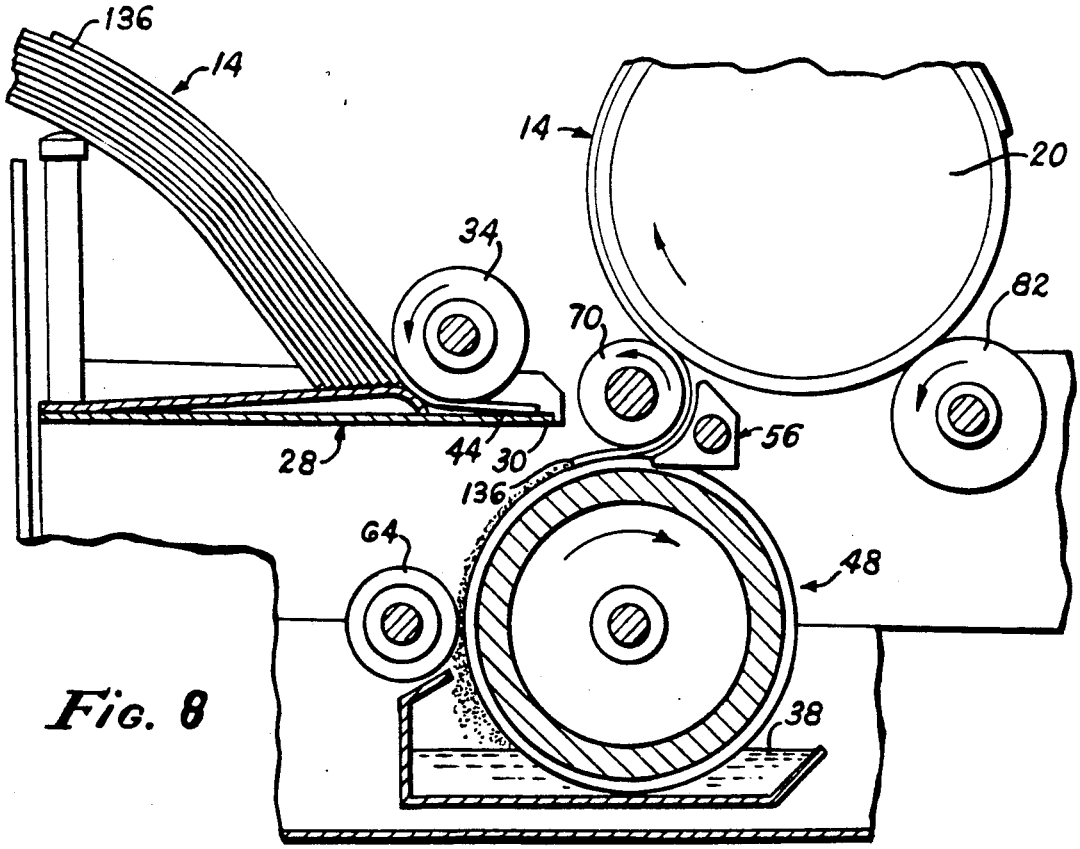
FIG. 8 is a cross-sectional view in diagrammatic form of the labelling machine of FIG. 1 showing a travelling label as the trailing edge of the label comes into contact with the glue-retaining surface.

As illustrated in FIG. 8, as the trailing edge 136 of the label 14 travels past the rearward-most edge 30 of the label feed table 28, the trailing edge 136 is caused to flip down into contact with the glue application roller 48. By this action the trailing edge 136 of the label 14 is caused to take on and retain glue from the glue application roller 48.

By the rotation of the container 20, the label 14 is smoothly applied to the container 20 where it is firmly retained on the container 20 by glue applied to the leading edge 44 of the label 14 and to the trailing edge 136 of the label 14.

The container 20 is thereafter removed from the container retention and rotating system and is replaced by a new container 20, whereupon the system is repeated.

If a wider label 14 is required, the label guides 24 are loosened with the label guide adjustment pins 26 and displaced outwardly along the label to accommodate the wider labels 14.

When a container 20 is taller than the previous container 20, the container guides 92 are loosened from the container guide bar 94 by loosening the container guide adjustment pins 96 and displaced further apart and then reclamped to the container guide adjustment bar 94. When a container 20 is wider than the previous container 20, the rearward container support shaft 84 is adjusted to a greater distance from the forward container support collars 20 by rotating the container support assembly adjustment crank 86.

The glue used in the invention can be any suitable label application glue known in the art. Hot melt glues and cold glues may be used. Hot melt glues heated to approximately 300° F. are preferred because such glues dry faster than cold glues.

The difference in the velocities between the surface speed of the rotating container 20 and the speed at which the label 14 is propelled by the label feed roller 34 can be any small difference greater than about 0.1%. Differences between about 0.5% and about 2% can be used in the invention.

Although the present invention has been described in considerable detail with reference to certain preferred versions, other versions are possible. Therefore, the spirit and scope of the appended claims should not necessarily be limited to the description of the preferred versions contained herein.

What is claimed is:

1. A device useful for applying a label to a cylindrical container, wherein the label has a face side, a back side, a leading edge, a central area and a trailing edge, the device comprising:

(a) a label repository for storing a plurality of labels;

(b) a first surface capable of retaining a layer of glue;

(c) a second surface disposed spaced-apart from, but proximate to, the first surface so as to define a narrow slit between the first and second surfaces;

(d) container retention means for retaining a cylindrical container at a location downstream of the narrow slit;

(e) transport means for removing a label from the label repository and serially transporting the label (i) to the first surface, (ii) through the narrow slit, and (III) to a cylindrical container retained within the container retention means;

(f) first deflection means for deflecting the leading edge of a label being transported by the transport means in such a way that the bottom side of the leading edge of the label contacts the first surface at an acute angle and at a location proximate to, and on the upstream side of, the narrow slit;

(d) second deflection means for lifting the leading edge of a label being transported by the transport means off of the first surface at a location proximate to, and on the downstream side of the narrow slit and deflecting the leading edge away from the first surface, the second deflection means being disposed adjacent to and downstream of the narrow slit; and (h) rotation means for rotating a container retained within the container retention means such that, at the location where a label transported by the transport means contacts the container, the label and the surface of the container travel in the same direction;

wherein a label being transported by the transport means is deflected by the first deflection means at a location more proximate to the second surface than to the first surface when measured from the narrow slit;

wherein a label being transported by the transport means is deflected by the first deflection means while being supported at a location more proximate to the second surface than to the first surface when measured from the narrow slit;

wherein a label being transported by the transport means is deflected away from the first surface in such a way that the bottom side of the label contacts a container retained within the container retention means at an acute angle;

wherein a label being transported by the transport means is contacted with a container retained within the container retaining means at a location more proximate to the second surface than to the first surface when measured from the narrow slit;

(i) means driving said rotation means and said transport means at respective first and second velocities, wherein said first velocity is greater than said second velocity.

wherein the device has no reciprocating mechanical means for physically lifting the center of a label being transported by the transport means away from the first surface;

so that, when glue is retained by the first surface, a label being transported by the transport means can pick up glue from the first surface on the back side of its leading edge, be placed into contact with a rotating container retained within the container retention means, be pulled off of the glue on the first surface and into contact with the second surface by a container surface velocity which is greater than the velocity at which the label is being transported by the transport means, and can pick up glue on the back side of its trailing edge as the trailing edge passes through the narrow slit.

2. The device of claim 1 wherein the transport means comprises a label support table having a forward portion and a rearward-most edge, and across which a travelling label is transported, from the forward portion, past the rearward-most edge to the first deflection surface, and wherein:

(a) the rearward-most edge of the label support table is disposed above the first deflection surface;

(b) the first deflection surface and the second surface are disposed above both the first surface; and (c) a container retained by the container retention means is disposed above the first deflection surface and the second surface.

3. The device of claim 1 wherein the first surface defines at least one radial groove.

4. The device of claim 1 wherein the first surface defines a plurality of radial grooves.

5. The device of claim 1 wherein the second surface is cylindrical.

6. The device of claim 5 wherein the second surface is rotatable in the direction of a label being moved by the transport means.

7. The device of claim 1 wherein the narrow slit is between about 0.2 and about 1.2 centimeters.

8. The device of claim 1 wherein the first deflection means comprises a surface whose cross-section defines a portion of a circle.

9. The device of claim 1 wherein the first deflection means comprises a surface which is cylindrical and wherein such cylindrical surface rotates in the direction of a label being moved by the transport means.

10. The device of claim 1 wherein the first deflection means comprises the second surface.

11. The device of claim 1 wherein the second deflection means comprises at least one finger member having an arcuate edge for lifting the leading edge of the travelling label off of the first surface and deflecting the leading edge away from the first surface.

12. The device of claim 1 wherein the second deflection means comprises a plurality of spaced-apart fingers, each finger having an arcuate edge for lifting the leading edge of the travelling label off of the first surface and deflecting the leading edge away from the first surface.

13. The device of claim 1 wherein the first velocity is less than 99.9% of the second velocity.

14. The device of claim 1 wherein the first velocity is between about 98% and about 99.5% of the second velocity.

15. A method for applying a label to a cylindrical container, wherein the label has a face side, a back side, a leading edge, a central area and a trailing edge, the method comprising, without the use of reciprocating mechanical label lifting means, the steps of:

(a) placing a label in a label repository;

(b) removing the label from the label repository and serially causing the label to travel at a first velocity into contact with a first deflection means for deflecting the leading edge of the traveling label to a first surface, upon which first surface is retained a layer of glue, such deflection being made in such a way that the back side of the leading edge of the label contacts the first surface at an accurate angle;

(c) passing the label through a narrow slit formed by the first surface and a second surface;

(d) lifting the leading edge of the traveling label off of the first surface immediately downstream of the narrow slit and deflecting the leading edge away from the first surface to a cylindrical container which is rotated at a second, greater velocity; and (e) contacting the rotating cylindrical container with the leading edge of the traveling label at an acute angle;

wherein the traveling label is supported at a location proximate to, and on the upstream side of the narrow slit, this location being more proximate to the second surface than to the first surface when measured from the narrow slit;

wherein the leading edge of the traveling label contacts the first deflection means at a location more proximate to the second surface than to the first surface when measured from the narrow slit;

wherein the traveling label contacts the rotating cylindrical container at a location proximate to and on the downstream side of the narrow slit, this location being more proximate to the second surface than to the first surface when measured from the narrow slit; and whereby, when the leading edge of the traveling label comes into contact with the rotating container, the label is retained by the container and is pulled thereby at the second velocity, and whereby the sudden increase in the label speed from the first velocity to the second velocity pulls the traveling label away from the first surface and against the second surface.

16. The method of claim 5 wherein, as a traveling label is being pulled by the rotating container, the trailing edge of the label is caused to come into contact with the first surface.

* * * * *